United States Patent [19]

Zust

[11] 4,352,471

[45] Oct. 5, 1982

[54] THREAD TENSIONING AND BRAKE DEVICE

[76] Inventor: John E. Zust, Rte. 1, Seay Rd., Spartanburg, S.C. 29302

[21] Appl. No.: 263,276

[22] Filed: May 13, 1981

[51] Int. Cl.[3] ..... B65H 59/10; B65H 59/36

[52] U.S. Cl. ..... 242/147 R; 242/152.1; 242/154

[58] Field of Search ..... 242/152.1, 147 R, 153, 242/154, 149; 226/195

[56] References Cited

U.S. PATENT DOCUMENTS

| | | | |
|---|---|---|---|
| 1,330,006 | 2/1920 | Reardon et al. | 242/147 R |
| 1,596,095 | 8/1926 | Gehman | 242/154 |
| 1,997,709 | 4/1935 | Williams | 242/154 |
| 2,594,510 | 4/1952 | Stearn | 242/154 X |
| 3,892,371 | 7/1975 | Zollinger | 242/152.1 |
| 3,897,916 | 8/1975 | Rosen | 242/152.1 X |
| 4,017,038 | 4/1977 | Paepke | 242/152.1 |

*Primary Examiner*—Stanley N. Gilreath
*Attorney, Agent, or Firm*—Dority & Flint

[57] ABSTRACT

A thread tensioning device includes spaced first and second thread passages A and B between which a brake member 18 is carried and a thread tensioning cylinder 28 is carried between the second thread passage and a third thread passage C whose position relative to the second passage means is variable to vary the extent of thread contact with the tensioning cylinder 28. In the event of machine stoppage, thread brake 18 holds the yarn against seat 16 to maintain thread taut about cylinder 28 to avoid thread breakage upon start-up.

8 Claims, 2 Drawing Figures

THREAD TENSIONING AND BRAKE DEVICE

BACKGROUND OF THE INVENTION

This invention relates to a thread tensioning device for use with textile machinery. Heretofore, tensioning devices have been provided which utilize a chamber having a spherical ball seated on an eyelet through which the thread passes whereby the weight of the ball tensions the thread such as shown in U.S. Pat. No. 3,892,371 and 4,017,038. The tension is varied either by using balls of different weight or by providing a plurality of balls in series which makes accurate tension control troublesome.

Other type devices have been proposed to provide more accurate tension control such as the magnetic arrangements for tensioning thread shown in U.S. Pat. No. 3,897,916 wherein magnetic force is used to brake and control the rotation of a wheel about which thread is wound for tensioning. However, such devices tend to become unduly complicated and expensive for the large numbers required in the market.

It has also been known to provide thread tensioning devices of the type in which thread is drawn over a friction member as it passes toward the textile machine with the tension of the thread being varied by changing the extent to which the thread contacts the surface of the tensioning member such as shown in U.S. Pat. No. 1,596,095. However, the problem occurs in devices of this type that during machine stoppage, the thread in contact with the friction member loses contact and becomes loose about the friction member whereby upon start-up of the machine, the thread is jerked against the friction member often resulting in thread breakage and damage.

Accordingly, an important object of the present invention is to provide a thread tensioning device which tensions thread simply and accurately and brake therefor.

Yet another important object of the present invention is to provide a thread tensioning and brake device which holds the thread tensioned during machine stoppage to avoid thread breakage.

Still another important object of the present invention is to provide a thread tensioning device which is maintained relatively free of dirt and lint and may be easily cleaned.

SUMMARY OF THE INVENTION

According to the present invention, the above objectives are accomplished by providing first and second passages through which the thread travels and between which a thread brake in the form of a spherical member is carried and a third yarn passage whose position is adjustable with respect to the second yarn passage such that the wrap of a thread about a cylindrical tensioning member may be varied by changing the relative positions of the second and third yarn passages and whereby during machine stoppage, the spherical member seats on an outlet of the first yarn passage to keep the thread tight about the tensioning member.

BRIEF DESCRIPTION OF THE DRAWINGS

The construction designed to carry out the invention will be hereinafter described, together with other features thereof.

The invention will be more readily understood from a reading of the following specification and by reference to the accompanying drawing(s) forming a part thereof, wherein an example of the invention is shown and wherein.

DESCRIPTION OF A PREFERRED EMBODIMENT

Figure 1:
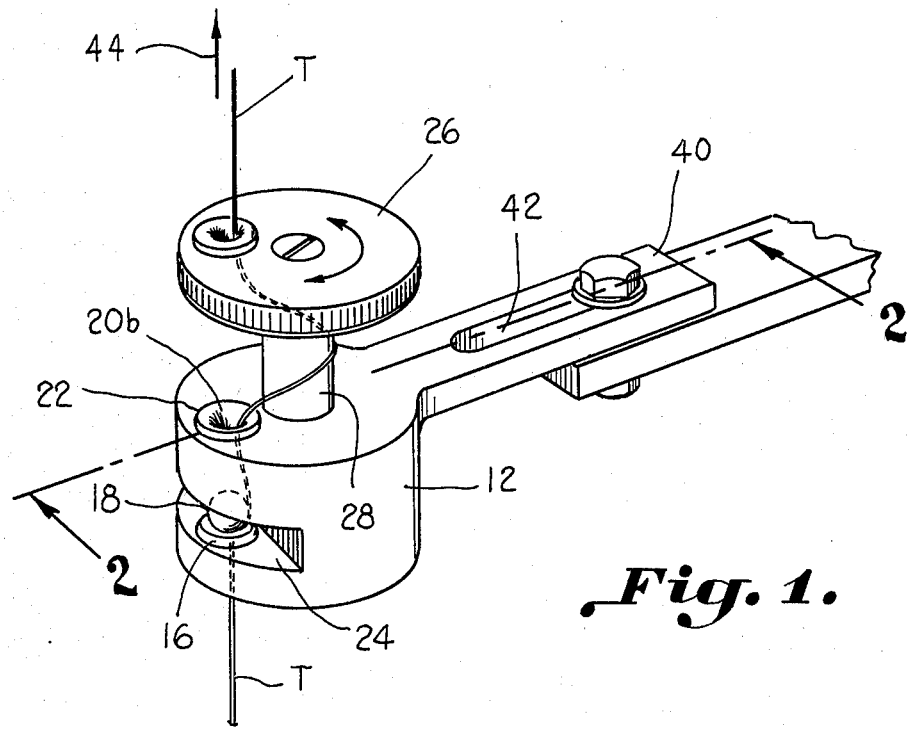
FIG. 1 is a perspective view of a thread tensioning and brake device according to the present invention.
Figure 2:
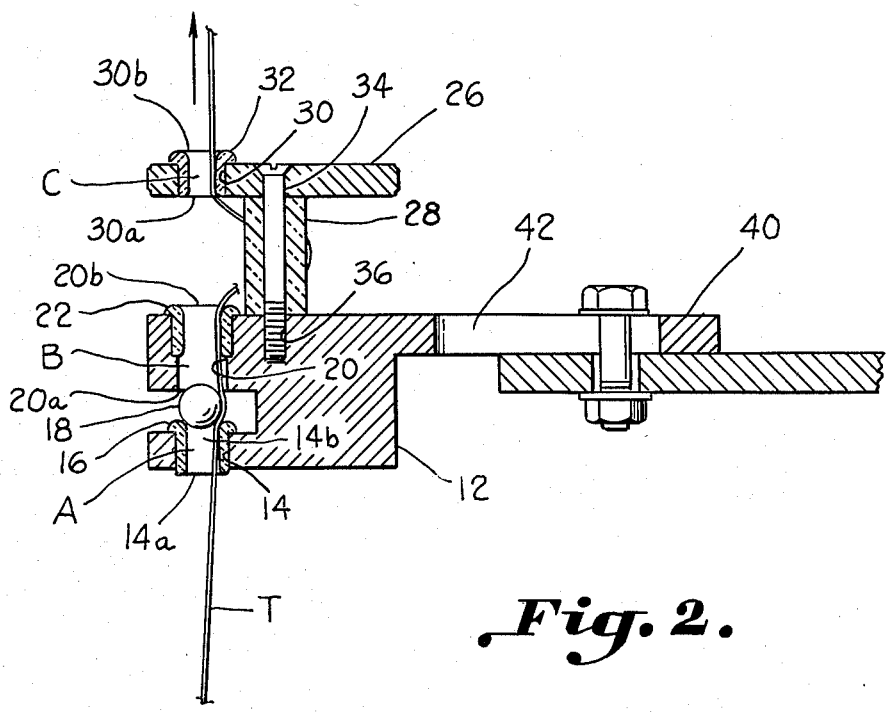
FIG. 2 is a sectional view taken along line 2—2 of FIG. 1.

The drawing illustrates a thread tensioning and brake device which includes a first passage means A having a thread inlet and a thread outlet with a brake means in the form of a spherical member seated on the thread outlet. A second passage means B is spaced generally above the first passage means A having a thread inlet and outlet through which the thread travels in general axial alignment with the first passage means. A chamber means is defined between the first and second passage means which is occupied by the spherical member. A third yarn passage means C is spaced generally above the second yarn passage means B having a thread inlet and outlet which may be varied in its position relative to the second yarn passage. A thread tensioning cylinder means is carried intermediate the second and third thread passage means against which the thread is tensioned as it travels to the machine. Means carrying the third yarn passage is provided by which the amount of wrap of the thread against the cylinder means may be varied and, hence, the tension thereof. Thread is maintained tight against the surface of the tensioning cylinder means during machine stoppage by the spherical member acting as a brake to hold the yarn against the outlet seat of the first passage means.

Referring now in more details to the drawing, a thread tensioning device, illustrated generally at 10, is shown as including a body portion 12 which includes first passage means A and second passage means B. The passage means A includes a bore 14 formed in the body 12 in which an eyelet is carried having a seat 16 against which spherical member 18 seats with thread T positioned as traveling therebetween. Passage means A further includes thread inlet **14*a* and outlet 14*b*. Passage means B includes bore 20 formed in body member 12 having an inlet 20*a* and an outlet 20*b* which also may include a ceramic eyelet 22**.

Chamber means for containing the ball 18 is provided by a lateral slot 24 formed in body member 12 which extends across the body portion to provide open sides which extends straight across the first passage outlet **14*b* and seat 16 which facilitates the removal of lint and dirt as well as reduces the accumulation thereof in the thread braking area. This space may be easily blown out by compressed air which is readily available at the machine site. As can be seen, the height of slot 24 is less than the diameter ball 18 to retain the ball in this chamber. Ball 18 is inserted through bore 20 by removing eyelet 22**.

Third passage means C is illustrated as being carried in plate means provided by a disk 26 carried atop a cylindrical member 28 which provides the tensioning cylinder means by which the thread is tensioned by friction. Passage means C includes a bore 30 formed in the disk 26 having an inlet at **30*a* and an outlet at 30*b* which may be provided by a ceramic outlet 32. A screw 34 may be utilized to assemble the disk 26 and cylinder member 28 to the body member 12 by means of threaded 36 formed in body member 12**.

Attachment means 40 may be provided for attaching the tensioning device to a proper support which may include a slot 42 for adjusting the positions of the tensioning device in alignment with the machine as is required in the direction of arrow 44.

It is preferred that the cylindrical member 28 be in the form of a ceramic cylinder having a smooth outer surface although stainless steel may also be utilized. The cylindrical member 28 extends generally perpendicular between respective horizontal planes which contain the outlet **20*b* of the second passage means B and the inlet 30*a* of passage means C and is laterally offset relative to these passages. Thus, thread T traveling through passage A encounters the spherical element 18 whereupon it travels through the passage B and around the cylindrical post 28 against which surface the thread is wrapped and tensioned by friction as it travels through the passage C on the way to the machine. Should the machine stop for any reason, the thread will be maintained tightly about cylinder 28 by virtue of the ball 18 and weight thereof holding the thread against the seat 16 in the form of a brake. Upon startup of the machine, the thread will be tensioned and will be pulled smoothly about the post 28. Jerking of the thread such as where it becomes loose about the post is avoided which reduces the likelihood of thread breakage. As illustrated, disk 26 may be turned to vary the position of passage C and the wrap and, hence, the contact of the thread against the surface 28** to thereby vary the friction and tension.

While a preferred embodiment of the invention has been described using specific terms, such description is for illustrative purposes only, and it is to be understood that changes and variations may be made without departing from the spirit or scope of the following claims.

What is claimed is:

1. A thread tensioning device for tensioning thread traveling to a textile machine, comprising:

first thread passage means having a thread inlet and a thread outlet;

second thread passage means spaced generally above said first passage means and in general axial alignment therewith having a thread inlet and outlet through which said yarn travels;

chamber means defined between said first and second passage means;

brake means carried in said chamber means between said first passage means and second passage means to brake the travel of thread therethrough;

a third thread passage means spaced generally above said second yarn passage means having a thread inlet and outlet, said third thread passage means being adjustable in position relative to the axial alignment of said first and second thread passage means;

thread tensioning cylinder means carried intermediate said thread outlet of said second passage means and said threat inlet of said third passage means for contacting and tensioning said thread traveling to said machine;

means carrying said third yarn passage means for varying said position and amount of contact of said thread about said cylinder means and hence the tension thereof; and said brake means braking said thread travel to maintain thread tight about said cylinder means during machine stoppage avoiding thread breakage upon start-up.

2. The device of claim 1 including lateral slot means extending across opposite sides of said chamber means and said thread outlet of said first passage means facilitating cleaning of said chamber means.

3. The device of claim 1 including a plate means carried adjacently atop said tensioning cylinder means which carries said third passage means, said disk being rotatable relative to said cylinder means to vary said wrap of thread thereabout and tension of yarn traveling through said third passage means.

4. The device of claim 3 wherein said plate means includes a knurled disk.

5. The device of claim 1 wherein said tensioning clyinder means includes a cylindrical member having a smooth outer surface extending generally perpendicular between respective horizontal planes which contain said thread outlet of said second passage means and said thread inlet of said third passage means and being laterally offset from said second and third passage means.

6. The device of claim 5 wherein said cylindrical member includes a ceramic cylinder.

7. The device of claim 1 wherein said brake means includes a spherical weighted member seated on said outlet of said first passage means.

8. The device of claim 2 wherein said brake means includes a spherical member and the height of said lateral slot means is less than the diameter of said spherical member.

* * * * *